US010702754B2

(12) United States Patent
Ianazone

(10) Patent No.: US 10,702,754 B2
(45) Date of Patent: Jul. 7, 2020

(54) GOLF TRAINING AID

(71) Applicant: LOCK-IN GOLF GRIP, LLC, Wesley Chapel, FL (US)

(72) Inventor: Anthony Victor Ianazone, Wesley Chapel, FL (US)

(73) Assignee: LOCK-IN GOLF GRIP, LLC, Wesley Chapel, FL (US)

( * ) Notice: Subject to any disclaimer, the term of this patent is extended or adjusted under 35 U.S.C. 154(b) by 0 days.

(21) Appl. No.: 16/533,878

(22) Filed: Aug. 7, 2019

(65) Prior Publication Data

US 2020/0047042 A1 Feb. 13, 2020

Related U.S. Application Data

(60) Provisional application No. 62/786,478, filed on Dec. 30, 2018, provisional application No. 62/737,065, filed on Sep. 26, 2018, provisional application No. 62/716,511, filed on Aug. 9, 2018.

(51) Int. Cl.
*A63B 69/36* (2006.01)
*A63B 60/10* (2015.01)

(52) U.S. Cl.
CPC ..... *A63B 60/10* (2015.10); *A63B 69/3632* (2013.01); *A63B 69/3685* (2013.01)

(58) Field of Classification Search
USPC ..... 473/205, 207, 213, 214, 223, 226, 227, 473/238, 257, 282, 275, 276, 277
See application file for complete search history.

(56) References Cited

U.S. PATENT DOCUMENTS 2,865,635 A * 12/1958 Jessen ..... A63B 69/3688 473/201
3,203,697 A * 8/1965 Berzatzy ..... A63B 60/10 473/538
3,712,618 A * 1/1973 Berzatzy ..... A63B 49/08 473/538
4,850,079 A * 7/1989 Thompson ..... B25D 1/00 16/421
5,127,650 A * 7/1992 Schneller ..... A63B 53/14 473/204
5,152,533 A * 10/1992 Radakovich ..... A63B 69/3632 473/206
5,772,523 A * 6/1998 Sheftic ..... A63B 69/3632 473/227
6,656,056 B1 * 12/2003 Leonard ..... A63B 57/00 473/227
6,881,155 B2 * 4/2005 Rohan-Weaver ..... A63B 53/14 473/219
8,663,024 B2 * 3/2014 Kardos ..... A63B 69/0059 473/212
9,573,040 B1 * 2/2017 Metz ..... A63B 69/3635
2004/0259655 A1 * 12/2004 Ferris ..... A63B 53/007 473/251

* cited by examiner

*Primary Examiner* — Nini F Legesse
(74) *Attorney, Agent, or Firm* — Sand, Sebolt & Wernow Co., LPA

(57) ABSTRACT

A golf training aid that may be attached to any golf club that may force a golfer's hands into the proper grip position for various types of golf shots is provided. The device and methods of the present disclosure may further allow a golfer to practice these shots to build muscle memory and to ingrain the proper grip positions into memory to allow for repeated and consistent shot performance.

19 Claims, 13 Drawing Sheets

GOLF TRAINING AID

CROSS REFERENCE TO RELATED APPLICATIONS

This application claims the benefit of U.S. Provisional Application Ser. No. 62/716,511, filed on Aug. 9, 2018; U.S. Provisional Application Ser. No. 62/737,065, filed Sep. 26, 2018; and U.S. Provisional Application Ser. No. 62/786,478, filed on Dec. 30, 2018; the disclosures of which are incorporated herein by reference.

TECHNICAL FIELD

The present disclosure relates generally to golf training aids. More specifically, the present disclosure relates to a golf training aid to assist a golfer in proper placement of the golfer's hands on the grip of a club. Specifically, the present disclosure relates to a training aid to properly align a golfer's top hand on the club to correctly address the ball and to instill muscle memory giving the golfer the proper grip.

BACKGROUND

Background Information

Golf is a sport that is enjoyed by many, ranging from the weekend warrior up to diehard amateurs and professionals. Millions of dollars are spent every year on golf equipment, golf lessons, and golf training aids to help lower golf scores and increase shot control and distance.

When learning to play golf or when practicing to become a better golfer, one of the first areas addressed is the proper grip of a golf club. The grip is the interaction between the golfer's hands and the golf club and can greatly affect the outcome of the shot. Specifically, an improper grip may give cause a ball to veer left or right and end up in a less desirable location.

There are different grip types that each has a different effect on the flight of the golf ball. Further, it may be desirable to change the grip to impart a specific type of spin on a ball to achieve a desired result. For example, a strong grip is when the back of the golfer's top hand is facing the sky when the person grips the club, and the shot is affected in that the ball tends to travel right to left, otherwise referred to as a draw or a hook when struck by a right handed golfer. Similarly, a weak grip is when the back of the top hand is facing the target when the person grips the club and the shot tends to travel left to right in what is known as a fade or a slice.

The preferred orientation of the top hand is typically somewhere between a weak and a strong grip with the V formed by the index finger and thumb of the golfer's top hand pointing up; however, it is also desirable to sometimes impart spin as previously discussed to direct the ball around an obstacle or hazard or to steer the ball around a turn in the hole, known as a dogleg. Accordingly, the grip is a vital component of hitting a golf shot that will perform according to the golfer's desire and intended approach.

Specifically then, when playing golf, it is highly desirable to be able to control the ball flight as a golfer may wish to hit the ball in a straight line in some situations and curve it left or right in others. Having the proper grip ingrained in memory may allow the golfer to adjust their hand position to achieve the desired results without affecting all of their shots, or their game as a whole. This may lead to lower scores and a higher degree of satisfaction garnered from playing the game.

Prior methods and training aids have lacked a way to force a golfer to place their hands in the correct position for specific golf shots that a golfer desired to make. Instead, previous solutions tend address grip generally or alternatively tend to teach grip without providing a mechanical mechanism to force the golfer to position their hands properly on the club. Further, prior solutions tend not to address the different grip positions for different types of golf shots.

SUMMARY

The present disclosure addresses these and other issues by providing a golf training aid that may be attached to any golf club that may force a golfer's hands into the proper grip position for various types of golf shots. The device and methods of the present disclosure may further allow a golfer to practice these shots to build muscle memory and to ingrain the proper grip positions into memory to allow for repeated and consistent shot performance.

In one aspect, an exemplary embodiment of the present disclosure may provide a golf training aid comprising: an alignment portion adapted to connect to a butt end of a golf club grip having a guide line disposed thereon; and a grip portion adapted to connect to the golf club grip; the grip portion further comprising: a body having an exterior wall with at least one alignment marking disposed thereon; a rigid strap extending outwardly from the body; and a clamp operable to secure the grip portion in place on the golf club grip; wherein the at least one alignment marking on the exterior wall of the body is operable to align with the guide line on the alignment portion to position the grip portion in the proper place for hitting a desired type of golf shot.

In another aspect, an exemplary embodiment of the present disclosure may provide a method of golf shot training comprising: attaching an alignment portion of a golf training aid to a butt end of a golf club grip; rotating the alignment portion until a guide line disposed thereon is parallel to a set of grooves formed in the face of a golf club; attaching a grip portion of the golf training aid to the golf club grip; rotating the grip portion until at least one alignment marking disposed on an exterior wall of a body thereof is aligned with the guide line of the alignment portion; securing the grip portion in place via a clamp; gripping the golf club grip such that a rigid strap extending from the body of the grip portion extends across the back of a golfer's top hand; and hitting a desired golf shot.

BRIEF DESCRIPTION OF THE SEVERAL VIEWS OF THE DRAWINGS

A sample embodiment of the disclosure is set forth in the following description, is shown in the drawings and is particularly and distinctly pointed out and set forth in the appended claims. The accompanying drawings, which are fully incorporated herein and constitute a part of the specification, illustrate various examples, methods, and other example embodiments of various aspects of the disclosure. One of ordinary skill in the art will appreciate that in some examples one element may be designed as multiple elements or that multiple elements may be designed as one element. In some examples, an element shown as an internal component of another element may be implemented as an external component and vice versa. Furthermore, elements may not be drawn to scale.

Similar numbers refer to similar parts throughout the drawings.

DETAILED DESCRIPTION

Figure 1A:
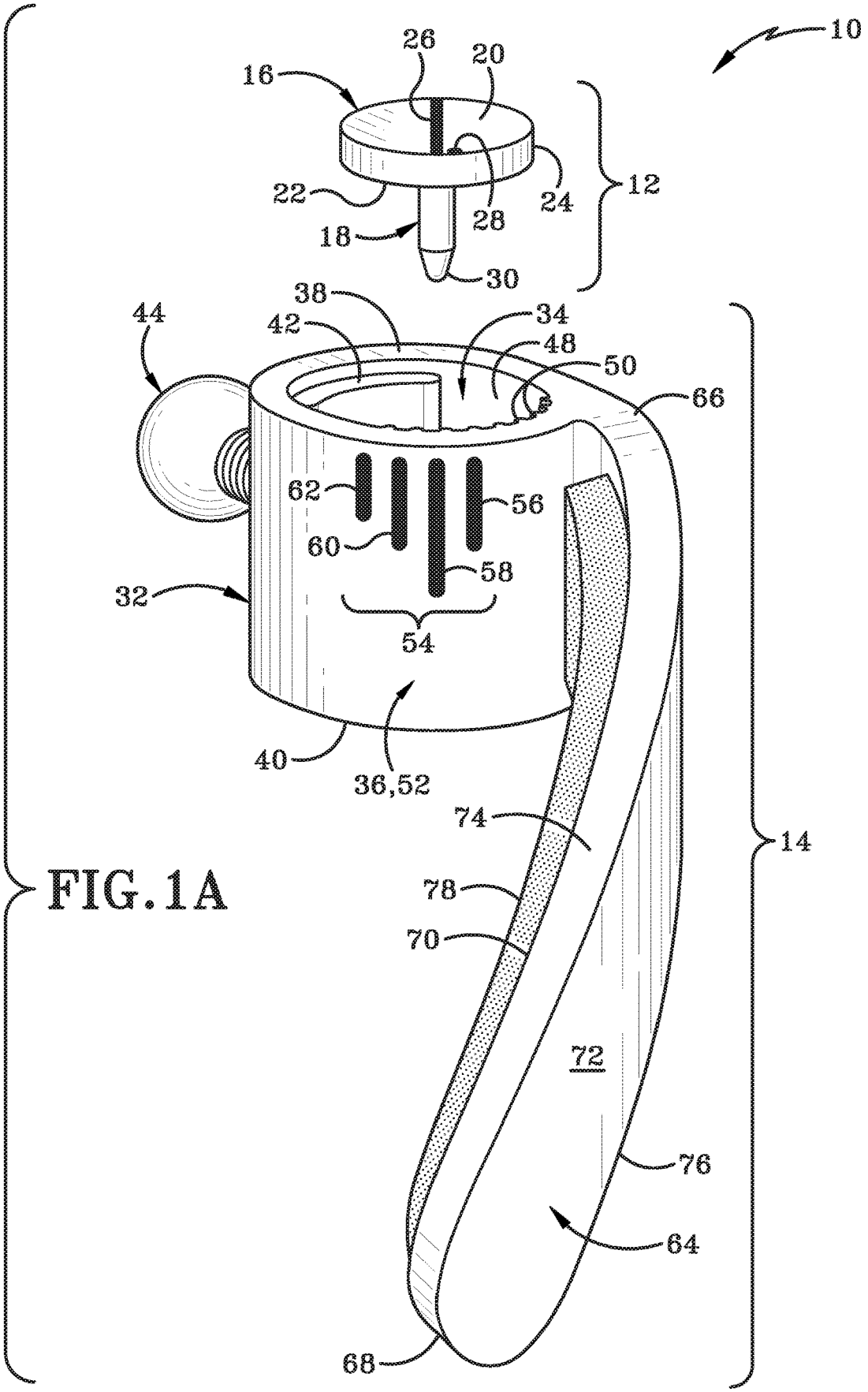
FIG. 1A is a front elevation view of a training aid of the present disclosure.
Figure 1B:
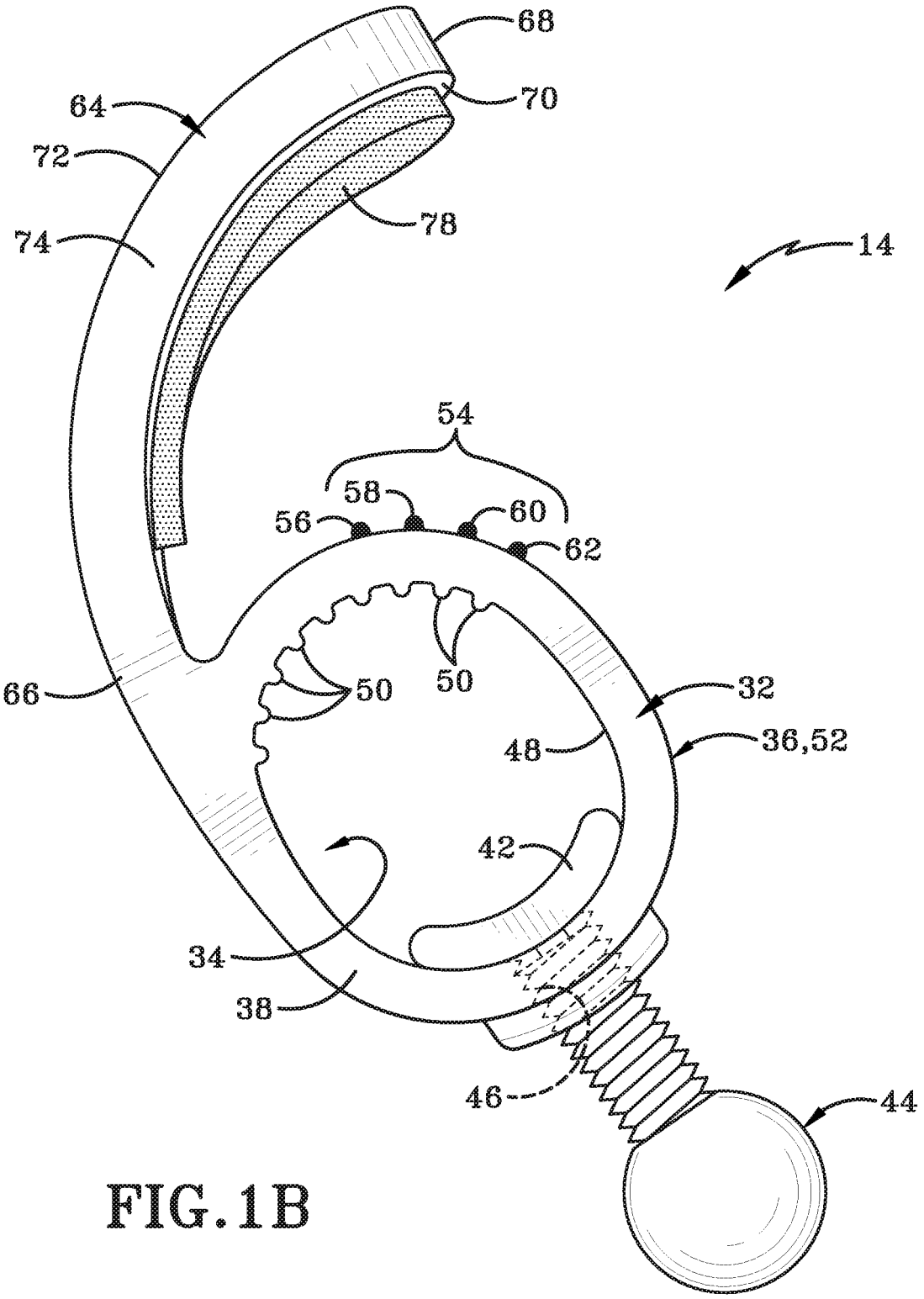
FIG. 1B is an overhead plan view of the grip portion of a training aid of the present disclosure.

With reference to FIGS. 1A and 1B, a golf training aid of the present disclosure is shown and generally indicated at reference 10. Golf training aid 10 may include two main components, namely, an alignment portion 12 and a grip portion 14.

Alignment portion 12 may include a head 16 and a post 18. Head 16 may have a top surface 20 spaced apart from a bottom surface 22 defining a vertical direction therebetween. Top surface 20 may be generally circular and may have a side wall 24 extending around the circumference of head 16. Top surface 20 may be defined as the surface pointing upwards when alignment portion 12 is installed on a golf club 80 as discussed further herein. Similarly, bottom surface 22 may be the portion pointed downwards and in contact with the butt end 81 of the grip 82 of a golf club as discussed herein. Head 16 may be approximately one inch in diameter to approximately match the diameter of most standard golf club grips 82; however, head 16 may vary in size according to the desired implementation.

Top surface 20 of head 16 may include a guide line 26 which may be used to align the alignment portion 12 in proper position on the butt end 81 of a golf club grip 82 as well as to align the grip portion 14 in the proper position for use, as discussed below. Guide line 26 may extend the full diameter of the head 16 and may be of a sufficient thickness and/or contrast to the top surface 20 to be easily visible when viewed by a golfer from above in a proper golf stance. Next to guide line 26 may be an offset marking 28 that may be used to align the alignment portion 12 in proper position when installed on a butt end 81, as well as to align the grip portion 14 in the proper position for use, of a driver 80B, which is a specific type of golf club 80, as discussed below.

Post 18 may extend downwards from bottom surface 22 of head 16 and may include a tapered end 30 to ease installation of alignment portion 12 into a grip hole 84 in the butt end 81 of a grip 82. Post 18 may be generally cylindrical in shape and may be sized appropriately to fit within the grip hole 84 of a standard golf club grip 82.

Alignment portion 12 may be formed of a rigid or semi-rigid material, such as plastic, metal, resin, phenolic, or the like, and may be constructed of a single piece. According to another aspect, alignment portion 12 may have a two-piece design with head 16 and post 18 formed separately and joined together through any suitable attachment means, such as adhesive, welding, or physical attachments such as bolts, screws, rivets, or the like.

Grip portion 14 may include a body 32 and a strap 64. Body 32 may have a hollow interior 34 and an exterior 36 defining therebetween the thickness of body 32. Body 32 may further include a top 38 which may be generally oriented upwards or towards the top of the golf club 80 when installed thereon, and a bottom 40 which may be separated vertically from the top 38 and may be oriented generally towards the head 79 of the golf club 80 when installed thereon. Body 32 may be generally oval or elliptical in cross section and may be slightly tapered top to bottom to conform to the tapered shape of a golf club grip 82. According to another aspect, body 32 may be substantially straight top to bottom.

The interior 34 of body 32 may define an interior wall 48 which may be the surface of body 32 that interacts with the grip 82 of the golf club 80. The interior wall 48 may include one of more ridges 50 formed or defined therein which may be integral to the interior wall 48, or alternatively, may be operably connected thereto. Ridges 50 may allow body 32 to be securely held in place and resist rotational movement when clamp 42 is tightened, as discussed below.

Ridges 50 may oppose or otherwise opposite clamp 42 within interior 34 such that clamp 42 may provide pressure to the shaft 90 of the golf club 80 directly opposite the ridges 50 to secure body 32 of grip portion 14 to the golf club 80. Clamp 42 may have a clamp screw 44 operationally connected thereto which may be a thumb screw or the like that may extend through an aperture 46 defined in through exterior and interior walls 48 and 52 of body 32. Clamp 42 may be a rigid or semi-rigid structure that is curved in or contoured to match the curve of the grip 82 of golf club 80 to facilitate a tight interaction therewith to prevent movement of grip portion 14 when installed on the golf club 80. According to one aspect, clamp 42 may be any suitable fastener to connect body 32 to the grip 82 of a golf club 80. According to another aspect, clamp 42 may be omitted.

Body 32 may further have an exterior wall 52 that circumscribes body 32. Exterior wall 52 may have a series of alignment markings 54 disposed thereon. Specifically, exterior wall 52 may have a first alignment mark 56, a second alignment mark 58, a third alignment mark 60, and a fourth alignment mark 62 disposed thereon. Alignment markings 54 may each correspond to specific types of golf shots, as discussed further below.

The series of alignment markings 54 may be formed as raised portions of exterior wall 52 of body 32 and may be colored or otherwise contrasted from body 32 as to be visible by the golfer when grip portion 14 is installed on the golf club 80. According to another aspect, alignment markings 54 may be painted, adhered, or otherwise affixed to the exterior wall 52 of body 32. According to another aspect, alignment markings 54 may be recessed or indented into exterior wall 52 of body 32.

Grip portion 14 may further include a strap 64. Strap 64 may have a first end 66 which may be the end closest to body 32 and a second end 68 which may be the end extending outward farthest from body 32. Strap 64 may have an inner face 70 which may be defined as the face angled towards a central portion of body 32 and an outer face 72 which may be defined as the face of strap 64 oriented away from the central portion of body 32. The inner face 70 may be spaced apart from outer face 72 and define the thickness of strap 64. Strap 64 may also include a top edge 74 spaced vertically apart from bottom edge 76 and may define the vertical height of strap 64 therebetween. The height of strap 64 may be equal to or substantially equal to the vertical height of body 32. Strap 64 may further include a pad 78 disposed on inner face 70 and following the contours thereof.

Strap 64 may be fixedly attached to body 32 or may be integrally formed therewith to give grip portion 14 a single piece construction. According to another aspect, strap 64 may be a separate piece and may be connected to body 32 by any suitable fastener such as bolts, rivets, screws, or the like. According to another aspect, strap 64 may be removable from or rotatable relative to body 32. According to another aspect, strap 64 may be clipped or fastened directly to the grip 82 of golf club 80.

Strap 64 may generally have an overall arcuate or curved shape such that when viewed from top 74, strap 64 may curve from an outer side of body 32 at the first end 66 towards a central portion of body 32 at the second end. Strap 64 may also be curved in a downward direction such that first 66 may be even with body 32 while second end 68 may curve downwards and terminate at a point below bottom 40 of body 32. According to another aspect, strap 64 may take any suitable shape operable to force a golfer's hand (such as top hand 92) into the proper grip position, as discussed further below.

The inner face 70 and pad 78 of strap 64 may define the main surface which will interact with the golfer's top hand 92 as discussed further herein with regards to the operation of training aid 10. Pad 78 may be formed of any suitable material to both cushion and provide comfort to the golfer when utilizing training aid 10. According to one aspect, pad 78 may be polyurethane foam or the like. According to another aspect, pad 78 may be a memory foam material. Pad 78 may be formed of any suitable cushioning and/or anti-friction material as desired according to the implementation of training aid 10.

The grip portion 14 of training aid 10, including body 32 and strap 64 may be formed from a rigid or semi-rigid material, such as plastic, metal, resin, phenolic, or the like, and may be formed using any suitable manufacturing method. According to one non-limiting example, grip portion 14 may be machined or milled from a single piece of material. According to another example, grip portion 14 may be molded.

Having described the components and features of training aid 10, the method of installation will now be described.

Figure 2A:
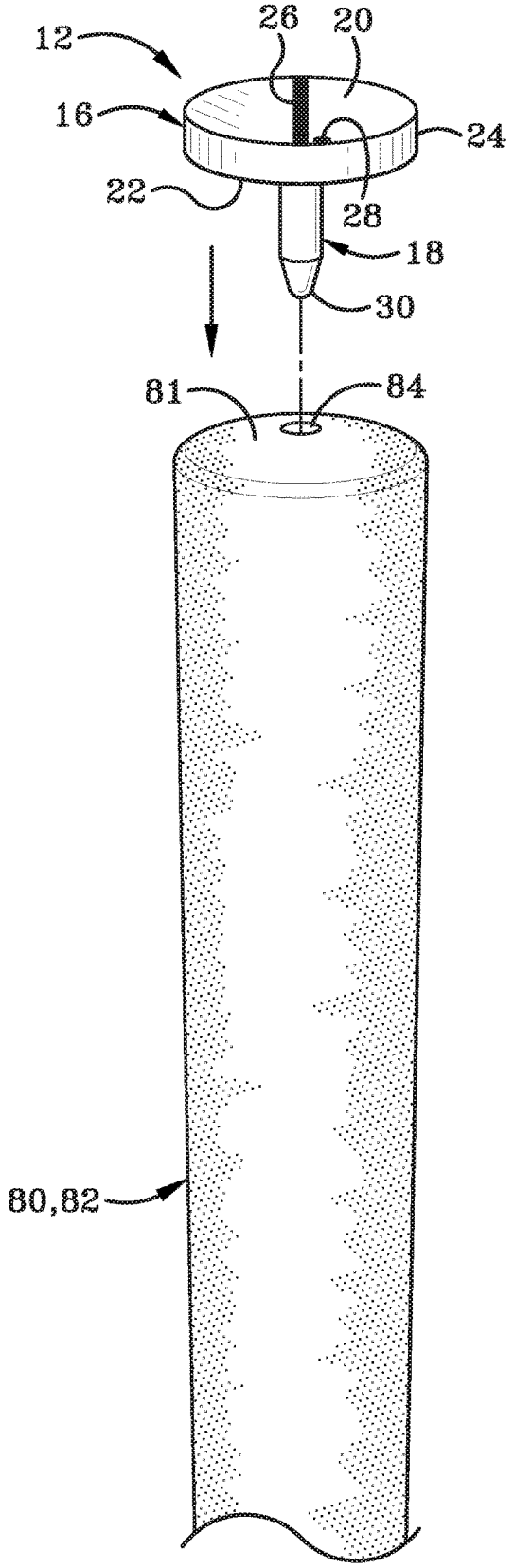
FIG. 2A is a front plan view of the alignment portion of a training aid of the present disclosure being installed on the grip of a golf club.
Figure 2B:
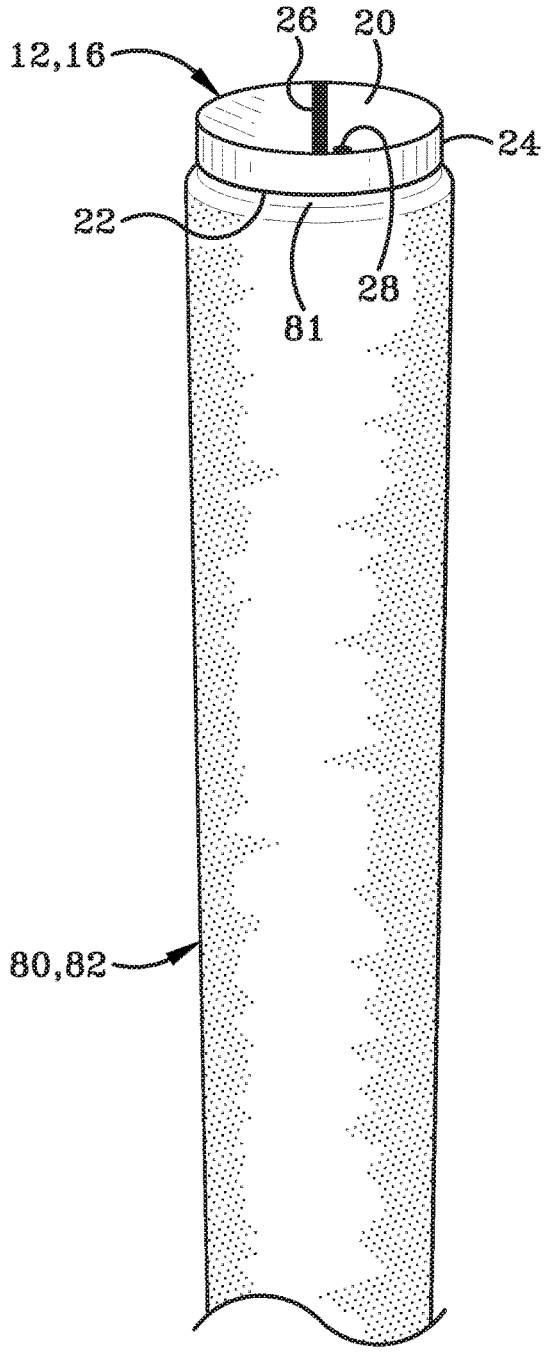
FIG. 2B is a front elevation view of the alignment portion of a training aid of the present disclosure having been installed in the grip of a golf club.
Figure 3:
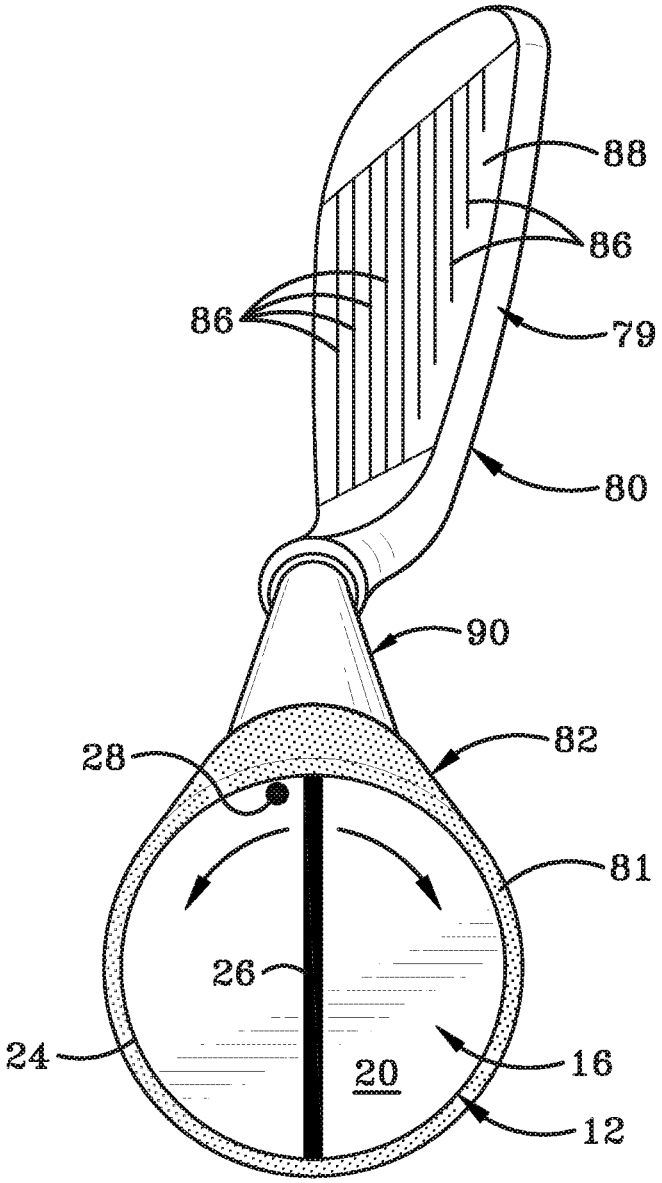
FIG. 3 is an overhead plan view of the alignment portion of a training aid of the present disclosure installed on a golf club.

With reference to FIGS. 2A, 2B, and 3, the alignment portion 12 of training aid 10 may be installed on the grip 82 of a golf club 80 by inserting post 18 into the grip hole 84 as indicated in FIG. 2A. Proper installation is achieved when the bottom surface 22 of alignment portion 12 is in contact with the butt end 81 of grip 82 and post 18 is fully inserted into grip hole 84. Such proper installation is shown in FIG. 2B.

Once installed, alignment portion 12 may be rotated clockwise or counterclockwise to align guide line 26 with the grooves 86 on the face 88 of the golf club 80. Proper positioning of alignment portion 12 is achieved when the guide line 26 is parallel to grooves 86 as indicated and shown in FIG. 3.

Figure 4:
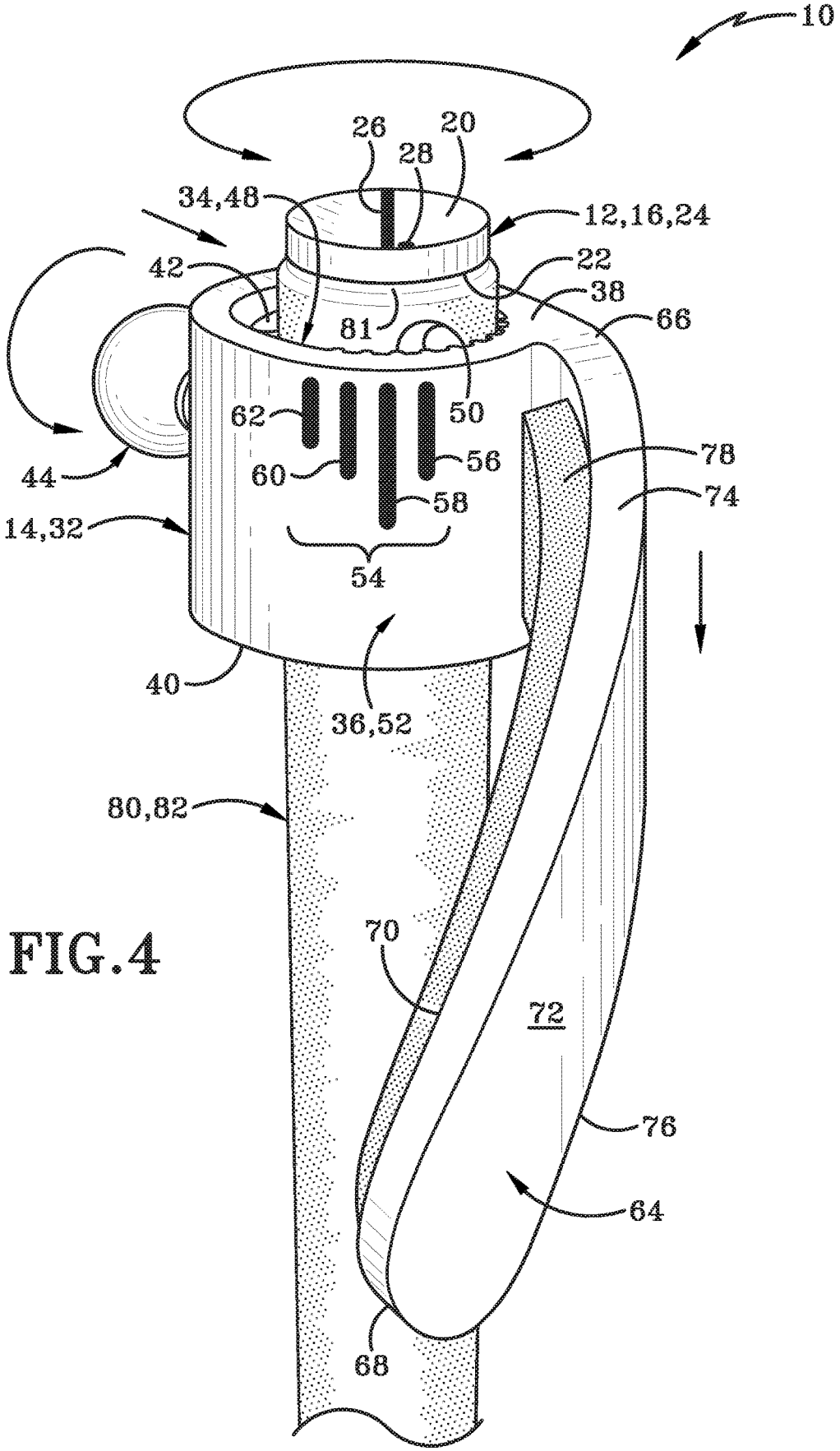
FIG. 4 is a top front perspective view of the training aid of the present disclosure as installed on a golf club.
Figure 5:
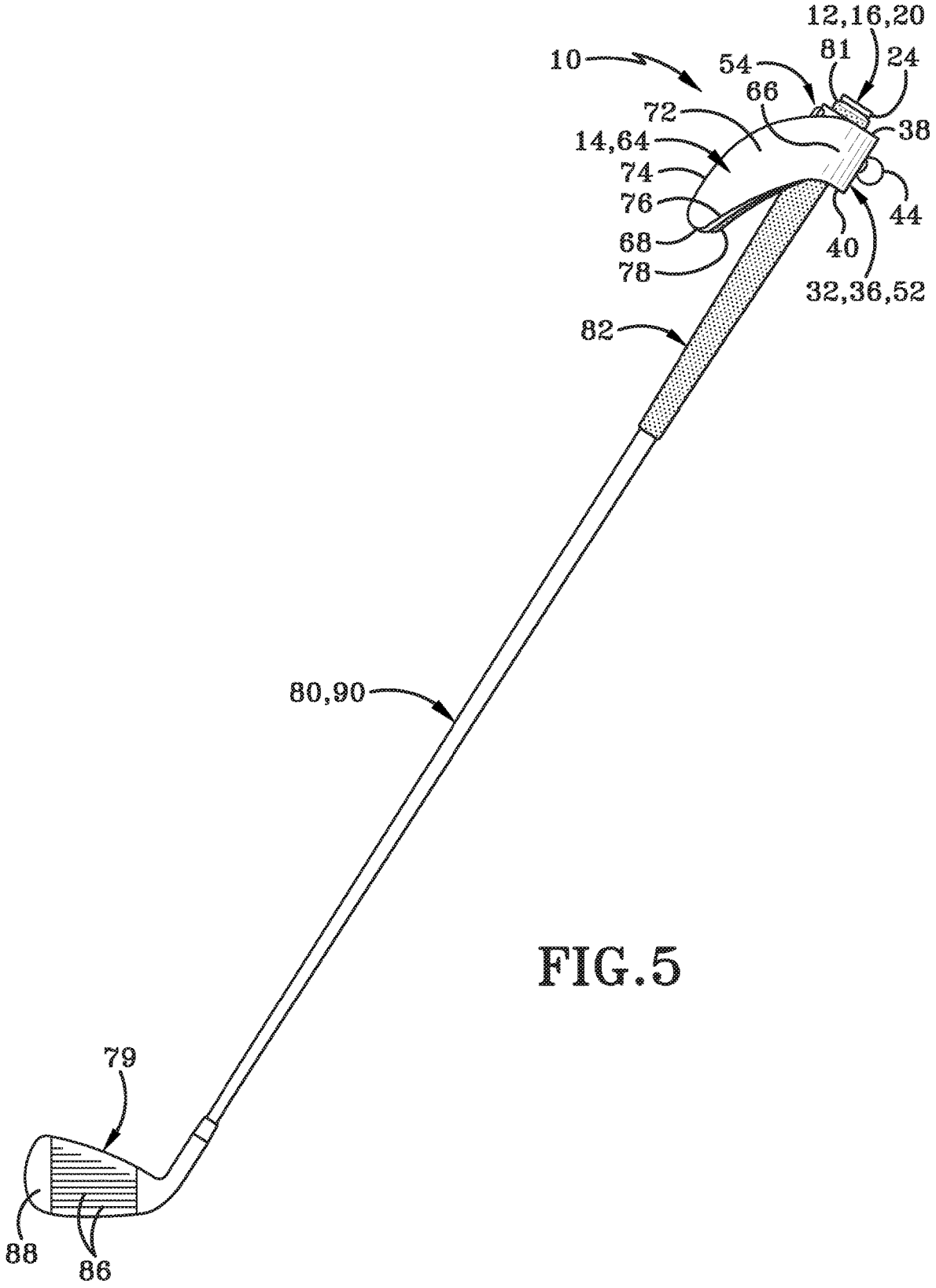
FIG. 5 is a side elevation view of the training aid of the present disclosure installed on a golf club.

With reference to FIGS. 4 and 5, installation of the grip portion 14 of training aid 10 is accomplished by first loosening clamp screw 44 and then inserting the butt end 81 of grip 82 through the interior 34 of body 32 and moving body 32 downwards towards the head 79 of golf club 80. Once the top 38 of body 32 is aligned with or slightly lower than the butt end 81 of grip 82, the clamp screw 44 may be rotated to tighten clamp and hold grip portion 14 in place. The golfer may then decide which shot he or she is planning to attempt and may align the grip portion 14 accordingly. Specifically, each alignment marking 54 may correspond to a specific type of golf shot. For example, for a right handed golfer, first alignment marking 56 make correspond to a draw shot; second alignment marking 58 may correspond to a straight shot; third alignment marking 60 may correspond to a fade shot; and fourth alignment marking 62 may correspond to a green-side bunker, or bunker, shot. Additional markings may be included to correspond to other golf shots, such as flop shots, chips, push shots, or pull shots. Alternatively, first through fourth markings 56, 58, 60, and/or 62 may correspond to other shots as dictated by the desired implementation. Alignment of the selected marking 54 may be accomplished by slightly loosening clamp screw 44 and rotating head 32 of grip portion 14 to the proper position before retightening clamp screw 44 and clamp 42. The proper positions and alignment relationships between alignment portion 12 and grip portion 14 is discussed further below with regards to the operation of training aid 10.

According to one aspect, the ridges 50 formed on the interior wall 48 of body 32 may help prevent unwanted rotation of grip portion 14 once clamp 42 is securely fastened by clamp screw 44.

Grip portion 14 may be adjusted vertically such that top surface 38 of body 32 may be aligned with or slightly below the butt end 81 of grip 82 in most scenarios; however, for younger golfers, shorter golfers, and/or for practicing specific shot types, grip portion 14 may be adjusted up or down grip 82 by loosening clamp screw 44 and clamp 42 and sliding body 32 of grip portion 14 up or down to the desired position and retightening clamp screw 44 and clamp 42. FIG. 5 best shows the positioning of grip portion 14 slightly below the butt end 81 of grip 82 as installed on golf club 80.

The grip portion 14 is therefore considered to be properly installed on a golf club 80 when the chosen alignment between grip portion 14 and alignment portion 12 is achieved and the clamp 42 and clamp screw 44 are securely tightened.

Having thus described the installation of training aid 10, a method of use and operation therefore will now be discussed.

Figure 6:
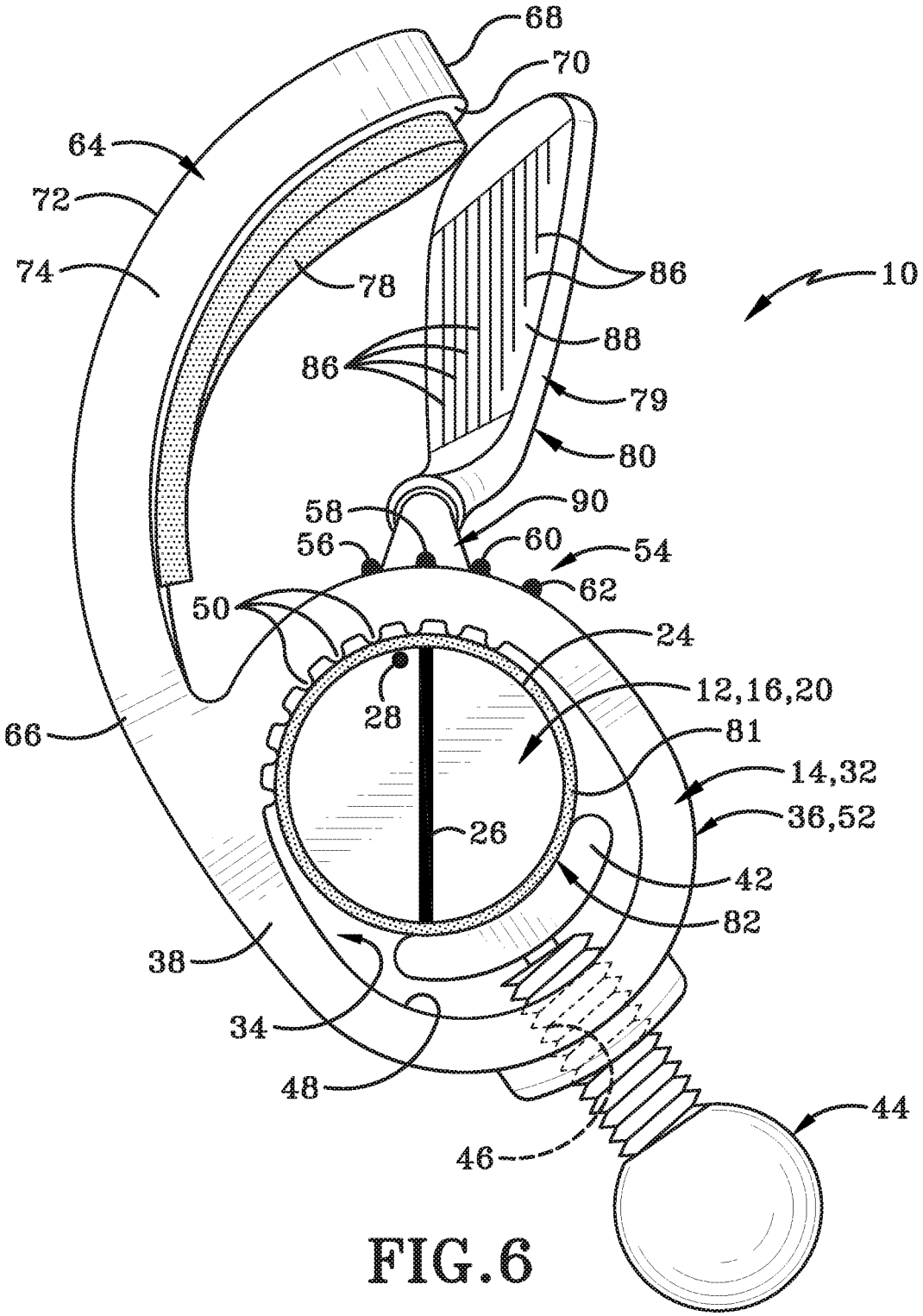
FIG. 6 is a top plan operational view of the training aid of the present disclosure as installed on a golf club.
Figure 10:
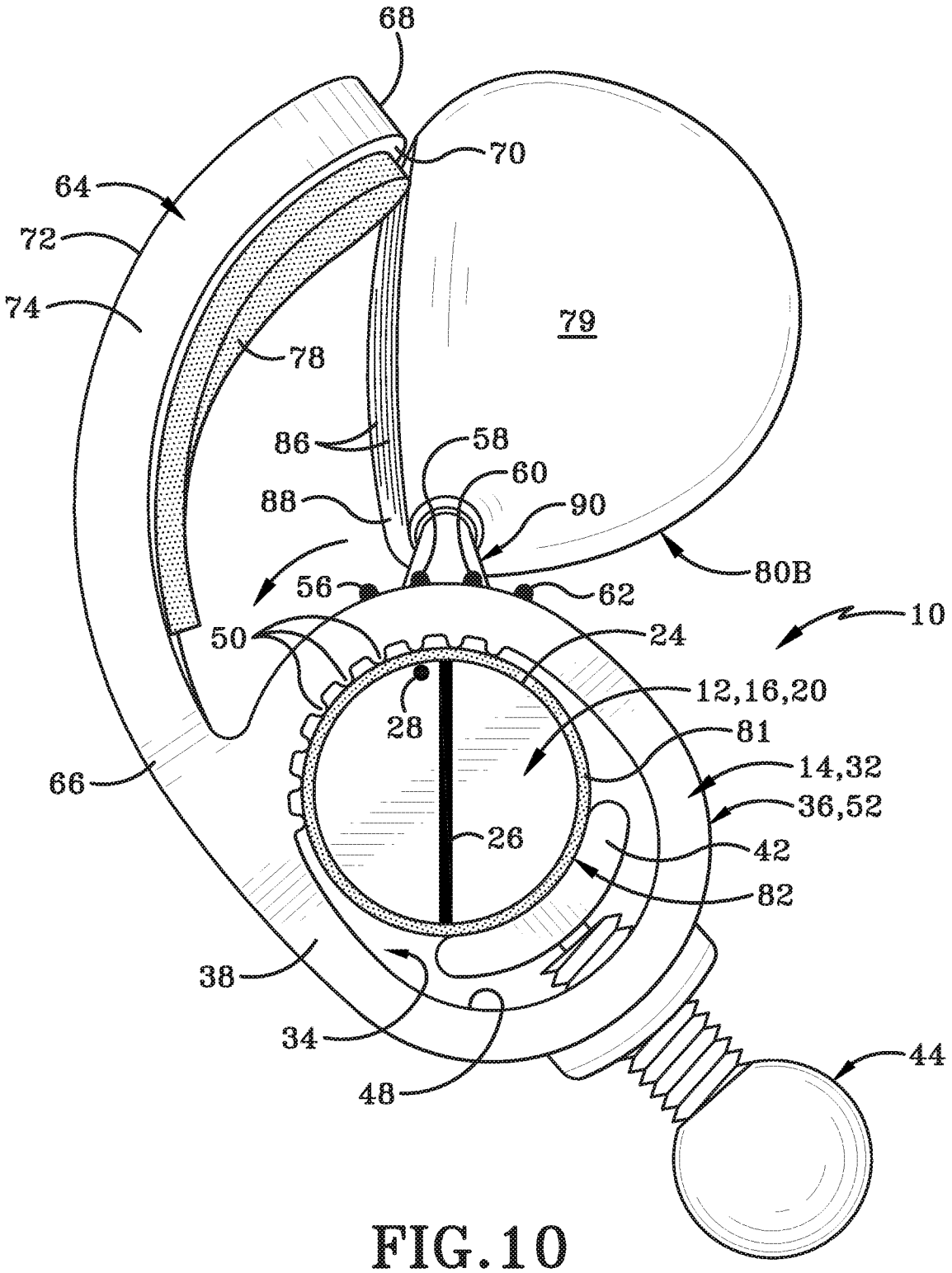
FIG. 10 is a top plan operational view of the training aid of the present disclosure as installed on a driver.
Figure 11:
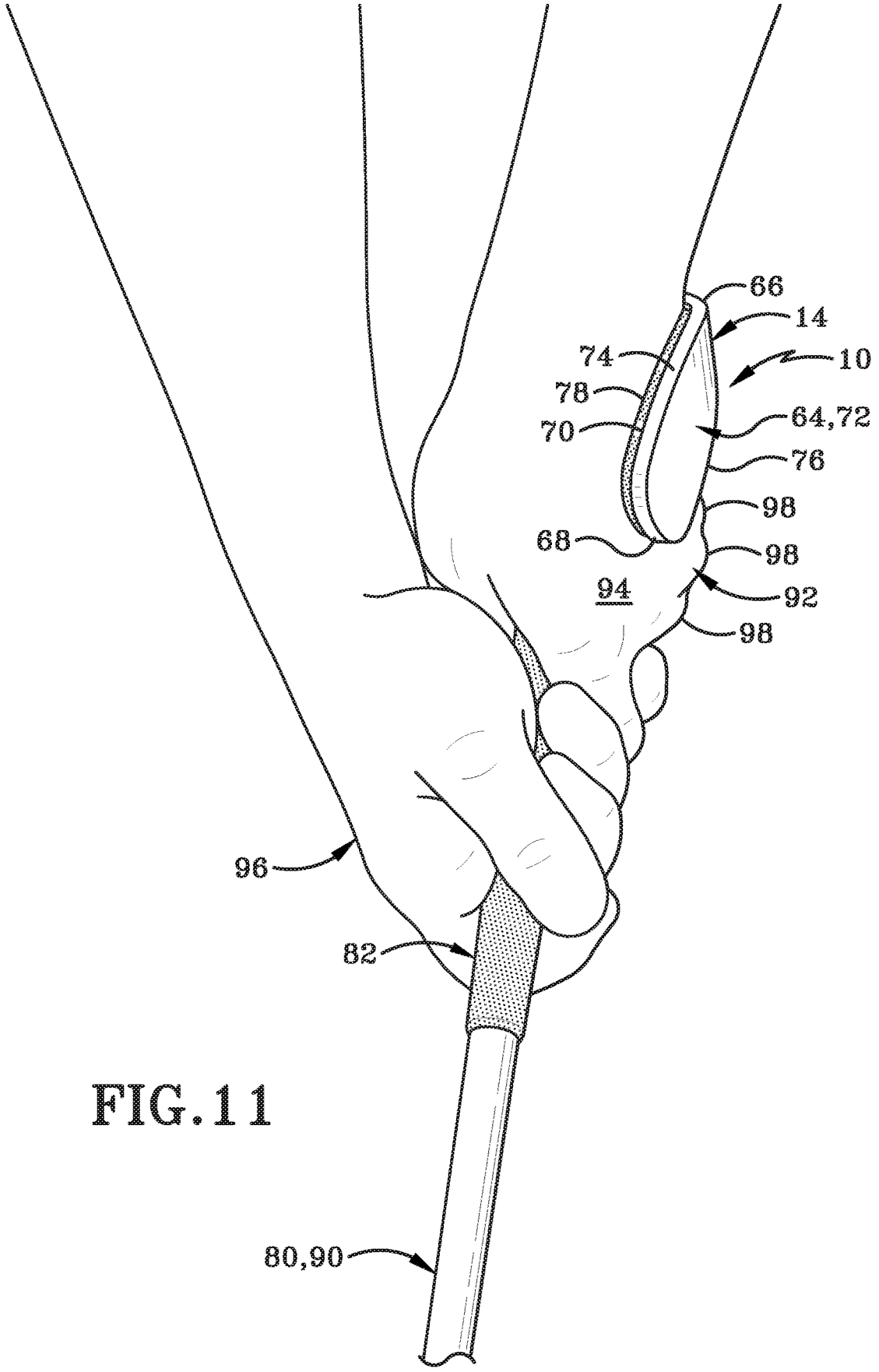
FIG. 11 is an operational front view of the training aid of the present disclosure as installed and being used by a golfer.
Figure 12:
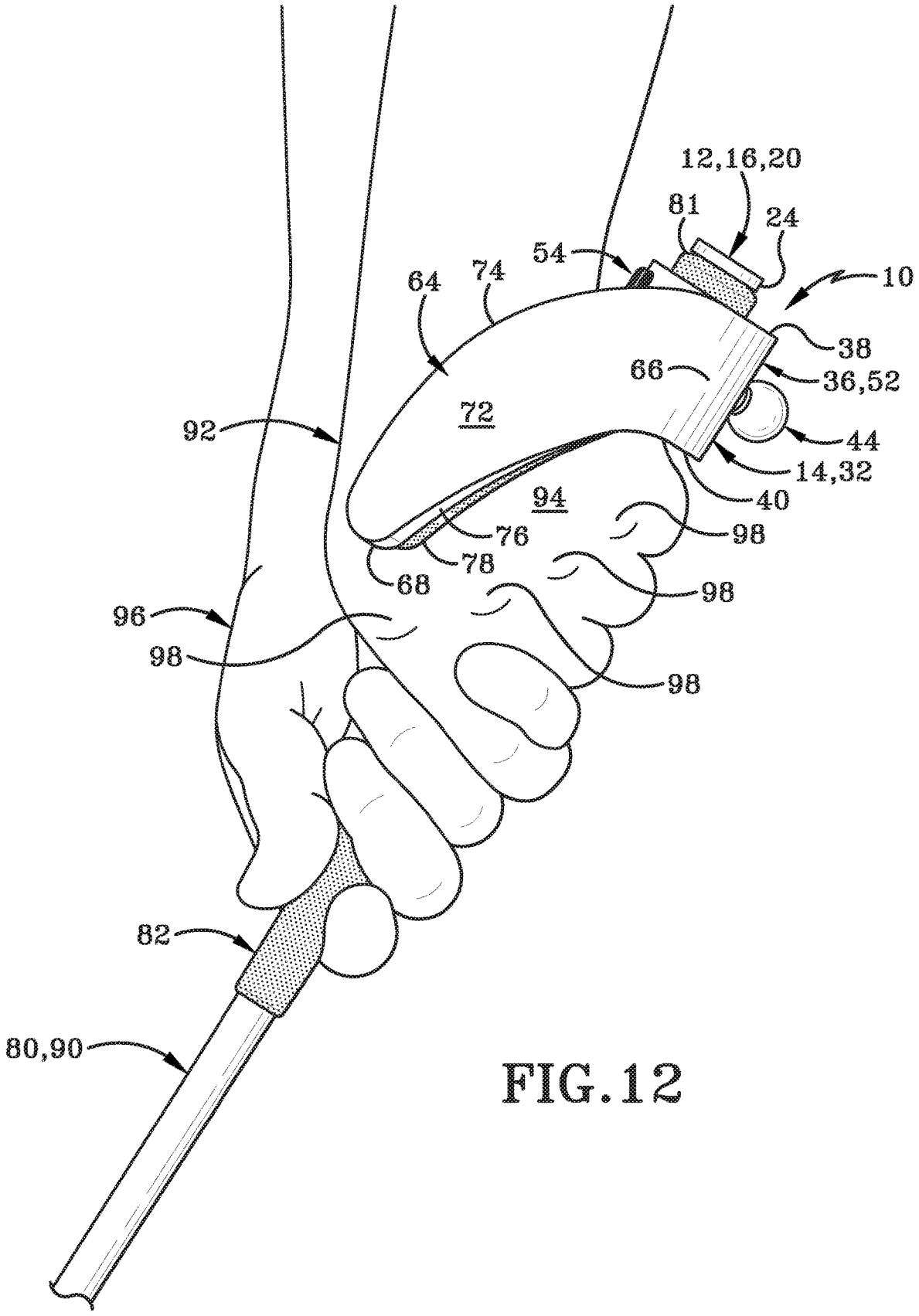
FIG. 12 is an operational side view of the training aid of the present disclosure as installed and being used by a golfer.

With reference to FIGS. 1A and 6-10, grip portion 14 may be installed on a golf club 80 (other than a driver 80B, discussed below) with the second alignment mark 58 aligned with guide line 26 as seen in FIG. 6. In this position, grip portion 14 is aligned for the golfer to practice hitting the ball straight. Specifically, with the grip portion 14 in this position, the golfer's top hand 92 may be inserted between the grip 82 and the strap 64 such that the pad 78 on inner face 70 of strap 64 may contact the back 94 of the golfer's top hand 92 just above the knuckles 98 (as best seen in FIGS. 11 and 12). This positioning of strap 64 may force the golfer's top hand 92 into the proper position to address the ball and hit the ball straight. With the grip portion 14 properly secured in this position, the golfer may hit multiple shots to achieve the proper feel of the hand placement and to train their muscles to maintain this grip position when desiring to hit the ball straight even without the use of training aid 10.

According to another aspect, strap 64 may interact with any portion of a golfer's top hand 92 in any suitable way as to force the top hand 92 into the proper grip position. By way of one non-limiting example, strap 64 may be shaped to wrap around the fingers of a golfer's top hand 92 to force the fingers into a proper grip position.

Figure 7:
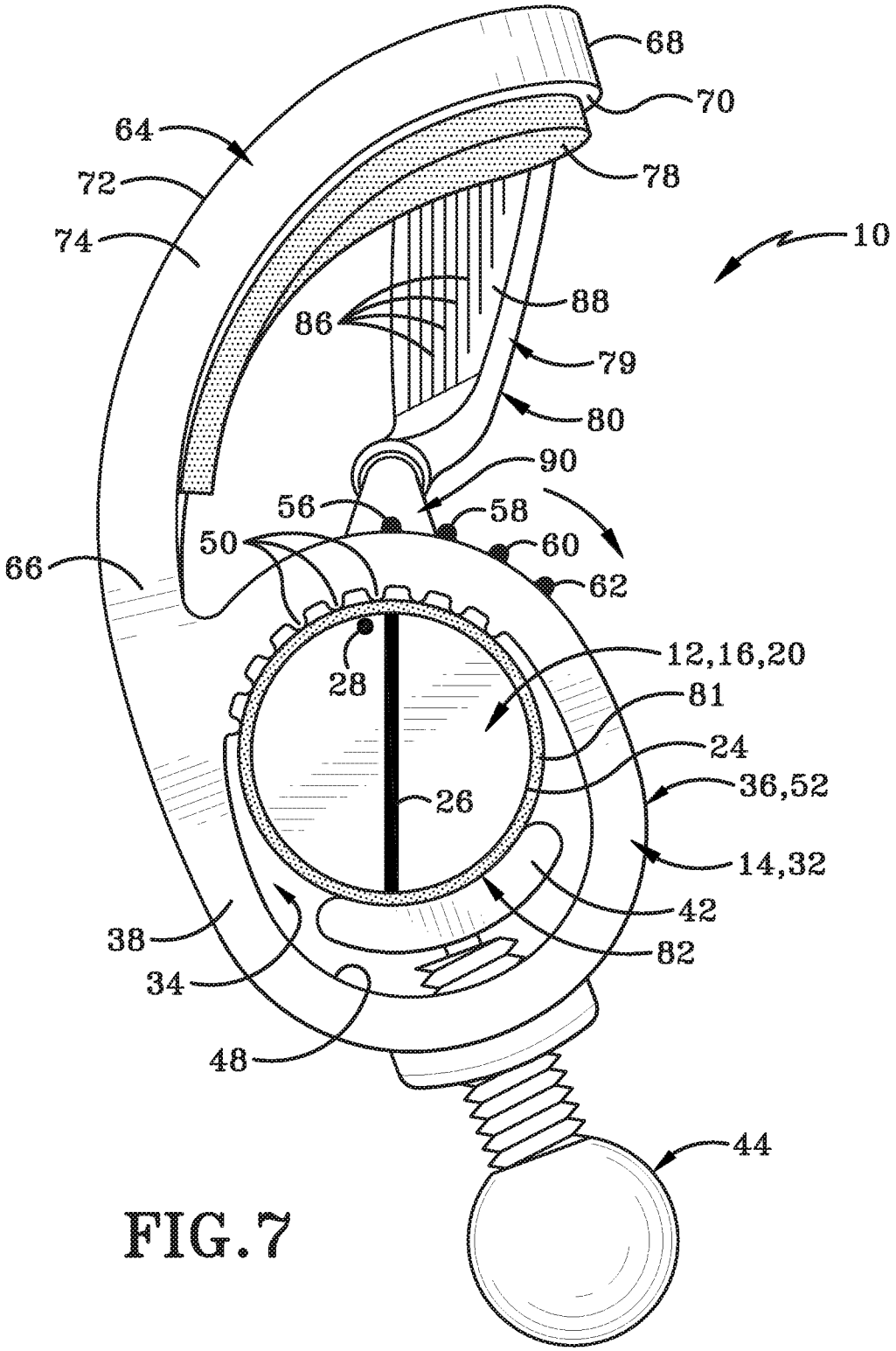
FIG. 7 is a top plan operational view of the training aid of the present disclosure as installed on a golf club in a second position.

As seen in FIG. 7, the grip portion 14 may be rotated clockwise to align the first alignment mark 56 with guide line 26 before tightening the clamp screw 44 and clamp 42 in position. With the grip portion 14 properly secured in this position and rotated relative to the head 79 of golf club 80, the golfer may again place his or her hands into the training aid 10 with the strap 64 across the back 94 of top hand 92. In this position, grip portion 14 is aligned for draw shots that curve right to left from a right-handed golfer. Again, the golfer may practice this shot to train their muscle memory with the proper grip position for a right to left draw shot for a right-handed golfer.

Figure 8:
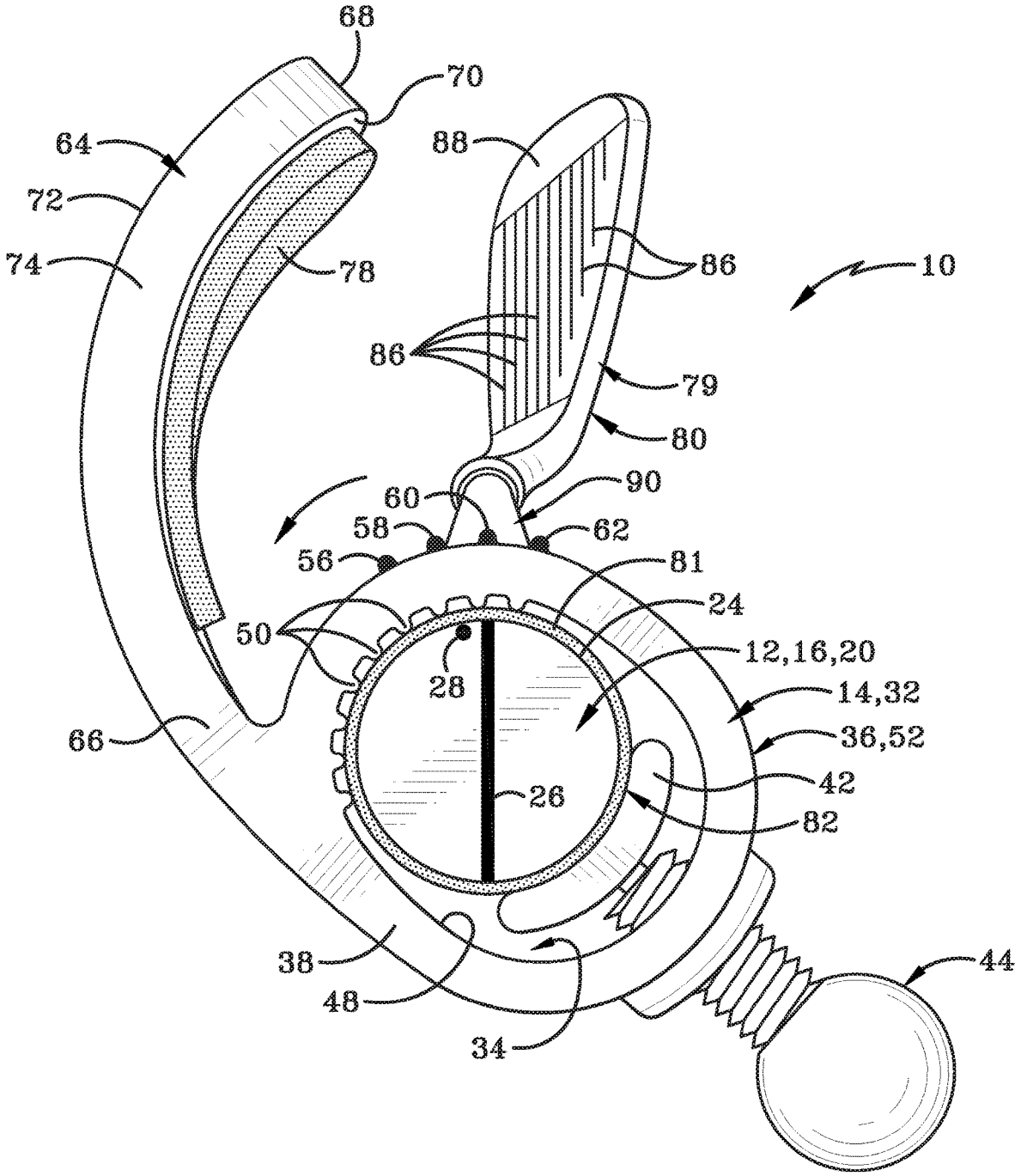
FIG. 8 is a top plan operational view of the training aid of the present disclosure as installed on a golf club in a third position.
Figure 9:
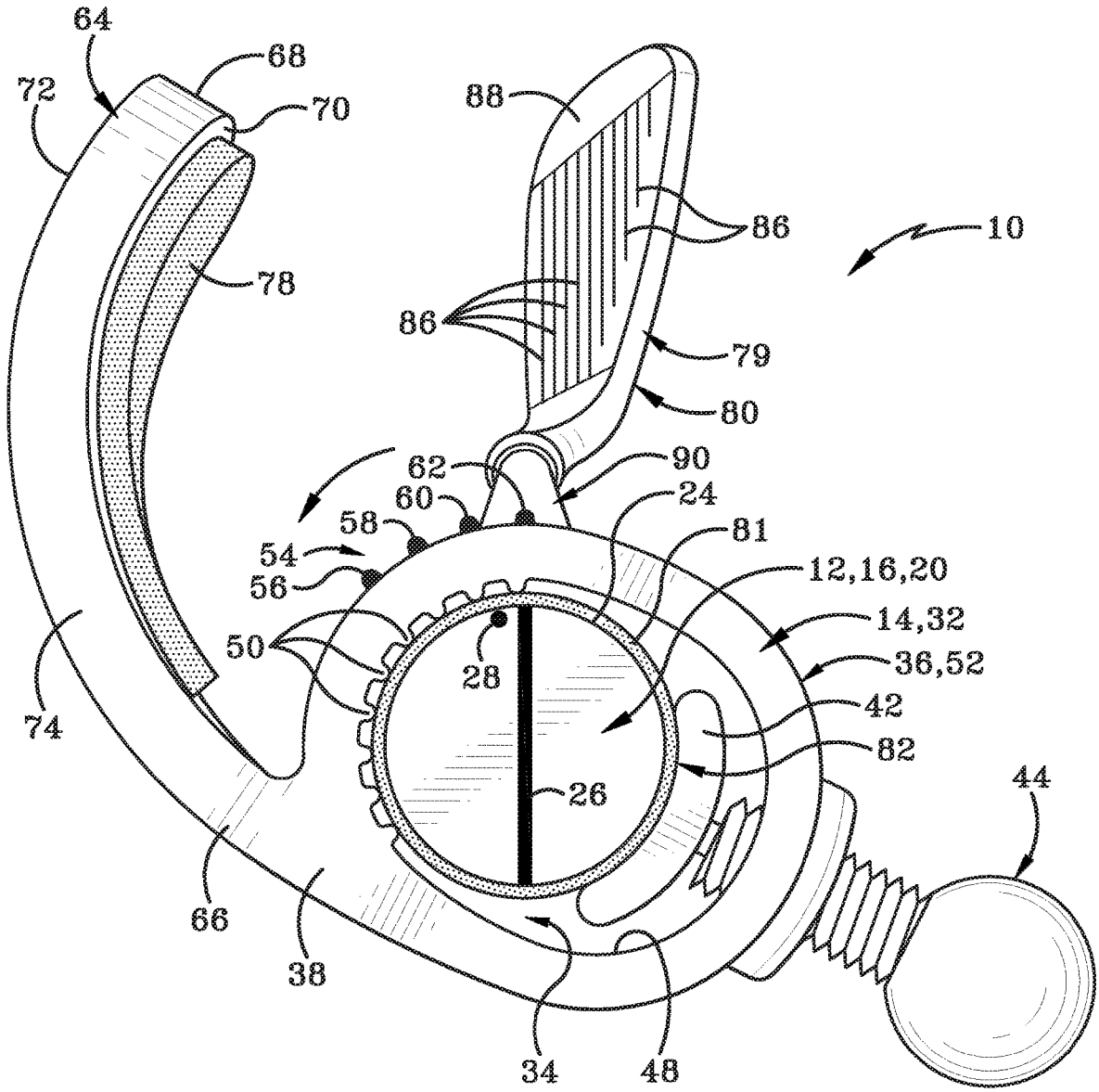
FIG. 9 is a top plan operational view of the training aid of the present disclosure as installed on a golf club in a fourth position.

As seen in FIG. 8, grip portion 14 may be rotated counterclockwise to align third alignment mark 60 with guide line 26 to allow a golfer to practice hitting a fade shot, with a curve from left to right for a right-handed golfer. Again, this may be achieved through proper grip placement and practice to train the golfer's muscle memory with the proper grip positioning to hit a fade shot.

For close in and/or short range shots, it is often desirable to open the face 88 of the golf club 80 to impart additional spin on the ball without overshooting the target. This is desirable, for example, in greenside bunker shots or short range flop shots where back spin may help the golfer land the ball in the most advantageous position on the green. To practice and train for these scenarios, grip portion 14 may be rotated further counterclockwise to align fourth alignment mark 62 with guide line 16 to open the face 88 of golf club 80 and allow the golfer to properly grip the club with an open face 88 for such shots and such control. Again, the golfer may then place his or her hands into the grip portion 14 with strap 64 aligned along the back 94 of the golfer's top hand 92 and may take multiple practice shots to further train the golfer with the proper grip for such shots.

For the majority of clubs 80, including fairway woods, irons, and wedges, the ball is typically addressed by the golfer between the golfer's feet and is most desirable to be struck on the down swing of golf club 80. However, when the golfer is addressing a tee shot utilizing a driver 80B, as illustrated in FIG. 10, the ball is typically placed closer to the front foot of the golfer's stance and struck on a slight upswing of the driver 80B. Therefore, the alignment of grip portion 14, or more particularly the alignment marks 54 of grip portion 14, with guide line 26 is contemplated for best use with golf clubs 80 other than the driver 80B. The inclusion of offset mark 28 on the top surface 20 of alignment portion 12 thus addresses the use of training aid 10 with a driver 80B. Therefore, with reference to FIG. 10, when using a driver 80B, the grip portion 14 may be rotated left or right to align the desired alignment mark 54 with the offset mark 28 to account for the change in position of the ball as the golfer addresses and takes his or her golf shot. Otherwise, the training aid 10 may be operated or utilized in the same manner regardless of club with the exception of the use of offset mark 28 with a driver 80B.

With reference to FIGS. 11 and 12, when properly installed and secured and in use by a golfer, the training aid 10 may be positioned with strap 64 extending across the back 94 of the golfer's top hand 92 with the golfer's bottom hand 96 interlocked with the golfer's top hand 92 and the thumb of the golfer's bottom hand 96 aligned down the shaft 90 of golf club 80. In this position, the strap 64 of grip portion 14 will curve around and across the back 94 of the top hand 92 just above the knuckles 98.

Although shown and described herein with reference to a training aid 10 for use with a right-handed golfer, it will be understood that similar principles and components may be utilized for a left-handed golfer with the grip portion 14 being constructed as a mirror image of what is shown for use with a left-handed golfer. According to one aspect, strap 64 may be interchangeable or rotatable to allow for use of training aid 10 by golfers of either hand. According to another aspect, strap 64 may be shaped and extend from body 32 in such a manner as to allow the user to invert the grip portion 14 on the golf club 80 to account for users of the opposite hand.

The placement position and placement of alignment markings 54 on exterior 36 of body 32 have been established based on the average position of professional golfers' hands for the varying types of shots and may not be perfectly situated for every particular golfer. Accordingly, it will be understood and contemplated that grip portion 14 may be rotated to any position about grip 82 of golf club 80 to accommodate varying hand sizes and placement for various golfers, thus allowing it to be universally applicable regardless of age, gender, hand size, or specific hand placement of the particular golfer utilizing training aid 10. According to this aspect, it will be further understood that once the proper positioning is determined, training aid 10 may still provide a golfer with repetitive muscle training to keep the grip in the same position throughout multiple shots to train the golfer in the proper grip and hand placement to hit the desired shots.

Various inventive concepts may be embodied as one or more methods, of which an example has been provided. The acts performed as part of the method may be ordered in any suitable way. Accordingly, embodiments may be constructed in which acts are performed in an order different than illustrated, which may include performing some acts simultaneously, even though shown as sequential acts in illustrative embodiments.

While various inventive embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the inventive embodiments described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the inventive teachings is/are used. Those skilled in the art will recognize, or be able to ascertain using no more than routine experimentation, many equivalents to the specific inventive embodiments described herein. It is, therefore, to be understood that the foregoing embodiments are presented by way of example only and that, within the scope of the appended claims and equivalents thereto, inventive embodiments may be practiced otherwise than as specifically described and claimed. Inventive embodiments of the present disclosure are directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the inventive scope of the present disclosure.

The articles "a" and "an," as used herein in the specification and in the claims, unless clearly indicated to the contrary, should be understood to mean "at least one." The phrase "and/or," as used herein in the specification and in the claims (if at all), should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc. As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of," or "exactly one of." "Consisting essentially of," when used in the claims, shall have its ordinary meaning as used in the field of patent law.

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

When a feature or element is herein referred to as being "on" another feature or element, it can be directly on the other feature or element or intervening features and/or elements may also be present. In contrast, when a feature or element is referred to as being "directly on" another feature or element, there are no intervening features or elements present. It will also be understood that, when a feature or element is referred to as being "connected", "attached" or "coupled" to another feature or element, it can be directly connected, attached or coupled to the other feature or element or intervening features or elements may be present. In contrast, when a feature or element is referred to as being "directly connected", "directly attached" or "directly coupled" to another feature or element, there are no intervening features or elements present. Although described or shown with respect to one embodiment, the features and elements so described or shown can apply to other embodiments. It will also be appreciated by those of skill in the art that references to a structure or feature that is disposed "adjacent" another feature may have portions that overlap or underlie the adjacent feature.

Spatially relative terms, such as "under", "below", "lower", "over", "upper", "above", "behind", "in front of", and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if a device in the figures is inverted, elements described as "under" or "beneath" other elements or features would then be oriented "over" the other elements or features. Thus, the exemplary term "under" can encompass both an orientation of over and under. The device may be otherwise oriented (rotated 90 degrees or at other orientations) and the spatially relative descriptors used herein interpreted accordingly. Similarly, the terms "upwardly", "downwardly", "vertical", "horizontal", "lateral", "transverse", "longitudinal", and the like are used herein for the purpose of explanation only unless specifically indicated otherwise.

Although the terms "first" and "second" may be used herein to describe various features/elements, these features/elements should not be limited by these terms, unless the context indicates otherwise. These terms may be used to distinguish one feature/element from another feature/element. Thus, a first feature/element discussed herein could be termed a second feature/element, and similarly, a second feature/element discussed herein could be termed a first feature/element without departing from the teachings of the present invention.

An embodiment is an implementation or example of the present disclosure. Reference in the specification to "an embodiment," "one embodiment," "some embodiments," "one particular embodiment," or "other embodiments," or the like, means that a particular feature, structure, or characteristic described in connection with the embodiments is included in at least some embodiments, but not necessarily all embodiments, of the invention. The various appearances "an embodiment," "one embodiment," "some embodiments," "one particular embodiment," or "other embodiments," or the like, are not necessarily all referring to the same embodiments.

If this specification states a component, feature, structure, or characteristic "may", "might", or "could" be included, that particular component, feature, structure, or characteristic is not required to be included. If the specification or claim refers to "a" or "an" element, that does not mean there is only one of the element. If the specification or claims refer to "an additional" element, that does not preclude there being more than one of the additional element.

As used herein in the specification and claims, including as used in the examples and unless otherwise expressly specified, all numbers may be read as if prefaced by the word "about" or "approximately," even if the term does not expressly appear. The phrase "about" or "approximately" may be used when describing magnitude and/or position to indicate that the value and/or position described is within a reasonable expected range of values and/or positions. For example, a numeric value may have a value that is +/−0.1% of the stated value (or range of values), +/−1% of the stated value (or range of values), +/−2% of the stated value (or range of values), +/−5% of the stated value (or range of values), +/−10% of the stated value (or range of values), etc. Any numerical range recited herein is intended to include all sub-ranges subsumed therein.

Additionally, any method of performing the present disclosure may occur in a sequence different than those described herein. Accordingly, no sequence of the method should be read as a limitation unless explicitly stated. It is recognizable that performing some of the steps of the method in a different order could achieve a similar result.

In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively, as set forth in the United States Patent Office Manual of Patent Examining Procedures.

In the foregoing description, certain terms have been used for brevity, clarity, and understanding. No unnecessary limitations are to be implied therefrom beyond the requirement of the prior art because such terms are used for descriptive purposes and are intended to be broadly construed.

Moreover, the description and illustration of various embodiments of the disclosure are examples and the disclosure is not limited to the exact details shown or described.

What is claimed:

1. A golf training aid comprising:

an alignment portion adapted to connect to a butt end of a golf club grip having a guide line disposed thereon; and a grip portion adapted to connect to the golf club grip; the grip portion further comprising:

a body having an exterior wall with at least one alignment marking disposed thereon;

a rigid strap extending outwardly from the body; and wherein the at least one alignment marking on the exterior wall of the body is operable to align with the guide line on the alignment portion to position the grip portion in the proper place for hitting a desired type of golf shot.

2. The golf training aid of claim 1 wherein the alignment portion further comprises:

a head having the guide line disposed on a top surface thereof; and a post extending downward from a bottom surface of the head, the post adapted to be inserted into a grip hole defined through the butt end of the grip.

3. The golf training aid of claim 2 wherein the alignment portion further comprises:

an offset marking disposed on the top surface of the head adjacent the guide line.

4. The golf training aid of claim 1 wherein the exterior wall of the body further comprises:

a plurality of alignment markings disposed thereon, wherein each alignment marking of the plurality of alignment markings is operable to align with the guide line on the alignment portion to position the grip portion in the proper place for hitting the desired type of golf shot.

5. The golf training aid of claim 4 wherein each alignment marking of the plurality of alignment markings corresponds to a specific golf shot that differs from the golf shot corresponding to each of the other alignment markings.

6. The golf training aid of claim 5 wherein the plurality of markings further comprises:

a first alignment marking corresponding to a draw shot;

a second alignment marking corresponding to a straight shot;

a third alignment marking corresponding to a fade shot; and a fourth alignment marking corresponding to a bunker shot.

7. The golf training aid of claim 1 wherein the at least one alignment marking corresponds to a golf shot that is one of a draw shot, a straight shot, a fade shot, and a bunker shot.

8. The golf training aid of claim 1 wherein the strap is curved and extends both outwardly and downwardly from the body of the grip portion.

9. The golf training aid of claim 8 wherein the strap further comprises:

an inner face;

an outer face; and a pad connected to the inner face.

10. The golf training aid of claim 9 wherein the strap is operable to force the proper grip position to hit the desired golf shot.

11. A method of golf shot training comprising:

attaching an alignment portion of a golf training aid to a butt end of a golf club grip;

rotating the alignment portion until a guide line disposed thereon is parallel to a set of grooves formed in the face of a golf club;

attaching a grip portion of the golf training aid to the golf club grip;

rotating the grip portion until at least one alignment marking disposed on an exterior wall of a body thereof is aligned with the guide line of the alignment portion;

securing the grip portion in place on the golf club grip;

gripping the golf club grip such that a rigid strap extending from the body of the grip portion extends across the back of a golfer's top hand; and hitting a desired golf shot.

12. The method of claim 11 further comprising:

aligning a first alignment marking disposed on the exterior wall of the body corresponding to a first desired golf shot with the guide line of the alignment portion; and hitting a first desired golf shot.

13. The method of claim 12 further comprising:

aligning a second alignment marking disposed on the exterior wall of the body corresponding to a second desired golf shot with the guide line of the alignment portion after hitting the first desired golf shot; and hitting a second desired golf shot.

14. The method of claim 13 further comprising:

aligning a third alignment marking disposed on the exterior wall of the body corresponding to a third desired golf shot with the guide line of the alignment portion after hitting one of the first and second desired golf shots; and hitting a third desired golf shot.

15. The method of claim 14 further comprising:

aligning a fourth alignment marking disposed on the exterior wall of the body corresponding to a fourth desired golf shot with the guide line of the alignment portion after hitting one of the first, second, and third desired golf shots; and hitting a fourth desired golf shot.

16. The method of claim 15 wherein:

the first desired golf shot is a draw shot;

the second desired golf shot is a straight shot;

the third desired golf shot is a fade shot; and the fourth desired golf shot is a bunker shot.

17. The method of claim 11 further comprising:

removing the alignment portion and the grip portion of the golf training aid; and hitting a desired golf shot without the use of the golf training aid.

18. The method of claim 11 wherein the alignment portion further includes an offset marking adjacent the guide line, the method further comprising:

rotating the grip portion until the at least one alignment marking disposed on the exterior wall of the body thereof is aligned with the offset marking of the alignment portion when the golf club is a driver; and rotating the grip portion until the at least one alignment marking disposed on the exterior wall of the body thereof is aligned with the guide line of the alignment portion when the golf club is a club other than a driver.

19. A golf training aid comprising:

an alignment portion adapted to connect to a butt end of a golf club grip having a guide line disposed thereon; and a grip portion adapted to connect to the golf club grip; the grip portion further comprising:

a body having an exterior wall with a plurality of alignment markings disposed thereon;

a rigid strap extending outwardly from the body; and wherein each alignment marking of the plurality of alignment markings on the exterior wall of the body is operable to align with the guide line on the alignment portion to position the grip portion in the proper place for hitting a desired type of golf shot and wherein each alignment marking of the plurality of alignment markings corresponds to a specific golf shot that differs from the golf shot corresponding to each of the other alignment markings.

* * * * *